US005297349A

United States Patent [19]

Kilgore

[11] Patent Number: 5,297,349

[45] Date of Patent: Mar. 29, 1994

[54] ATHLETIC SHOE WITH REARFOOT MOTION CONTROL DEVICE

[75] Inventor: Bruce J. Kilgore, Lake Oswego, Oreg.

[73] Assignee: Nike Corporation, Beaverton, Oreg.

[21] Appl. No.: 659,175

[22] Filed: Feb. 22, 1991

Related U.S. Application Data

[63] Continuation-in-part of Ser. No. 433,436, Nov. 8, 1989, Pat. No. 5,046,267, which is a continuation of Ser. No. 115,661, Nov. 6, 1987, abandoned.

[51] Int. Cl.[5] ..... A43B 13/12; A43B 5/00

[52] U.S. Cl. ..... 36/114; 36/30 R; 36/31

[58] Field of Search ..... 36/31, 30 R, 114, 29, 36/28, 69, 143, 144

[56] References Cited

U.S. PATENT DOCUMENTS

| | | | |
|---|---|---|---|
| Re. 27,243 | 3/1929 | Hiss . | |
| 43,052 | 6/1864 | Wade . | |
| 43,469 | 7/1864 | Bacon et al. . | |
| 174,174 | 2/1876 | Adgate . | |
| 549,252 | 11/1895 | Parker et al. . | |
| 1,285,426 | 11/1918 | Shaw . | |
| 1,470,592 | 10/1923 | Berthet . | |
| 1,625,346 | 4/1927 | Zerga . | |
| 2,034,243 | 3/1936 | Maxwell | 36/108 |
| 2,156,532 | 5/1939 | Grieder | 36/2.5 |
| 2,237,190 | 4/1941 | McLeod | 36/29 |
| 2,244,504 | 6/1941 | Riddell | 36/68 |
| 2,255,100 | 9/1941 | Brady | 36/71 |
| 2,497,175 | 2/1950 | Mantos . | |
| 2,635,362 | 4/1953 | Lelyveld | 36/8.5 |
| 2,638,689 | 5/1953 | Stritter | 36/68 |
| 2,660,814 | 12/1953 | Ritchey | 36/71 |
| 2,677,906 | 5/1954 | Reed | 36/71 |
| 2,723,468 | 11/1955 | Marcy | 36/68 |
| 2,885,797 | 5/1959 | Chrencik | 36/2.5 |
| 3,120,712 | 2/1964 | Menken | 36/29 |
| 3,333,353 | 8/1967 | Garcia | 36/68 |
| 3,393,460 | 7/1968 | Romen . | |
| 3,724,106 | 4/1973 | Magidson | 36/44 |
| 3,738,373 | 6/1973 | Glancy | 128/585 |
| 4,128,950 | 12/1978 | Bowerman et al. | 36/30 R |
| 4,183,156 | 1/1980 | Rudy | 36/44 |
| 4,255,877 | 3/1981 | Bowerman | 36/129 |
| 4,287,675 | 9/1981 | Norton et al. | 36/129 |
| 4,288,929 | 9/1981 | Norton et al. | 36/69 |
| 4,297,797 | 11/1981 | Meyers | 36/44 |
| 4,316,334 | 2/1982 | Hunt | 36/91 |
| 4,322,895 | 4/1982 | Hockerson | 36/129 |
| 4,354,318 | 10/1982 | Frederick et al. | 36/30 R |
| 4,360,027 | 11/1982 | Friedlander et al. | 128/581 |
| 4,364,188 | 12/1982 | Turner et al. | 36/31 |
| 4,364,189 | 12/1982 | Bates | 36/31 |
| 4,372,058 | 2/1983 | Stubblefield | 36/32 |

(List continued on next page.)

FOREIGN PATENT DOCUMENTS

| | | |
|---|---|---|
| 315340 | 5/1989 | European Pat. Off. . |
| 2487646 | 2/1982 | France . |
| 1020503A | 1/1986 | Japan . |
| 2114869 | 9/1983 | United Kingdom . |

OTHER PUBLICATIONS

Article on "Shoe Modifications in Lower-Extremity Orthotics" by Zamsoky and published by the Bulletin of (List continued on next page.)

*Primary Examiner*—Steven N. Meyers

*Attorney, Agent, or Firm*—Banner, Birch, McKie & Beckett

[57] ABSTRACT

A cushioning sole for use in footwear, in particular athletic shoes, is disclosed. The cushioning sole includes a rearfoot motion control device incorporated into a sole member. The device preferably functions to gradually control pronation motion. The device includes generally vertically extending rigid members and a plurality of horizontally extending plate members. In other preferred embodiments, a cushioning sole for use in footwear includes a rearfoot motion control device formed integrally with a heel supporting element, substantially rigid and generally vertical members of the rearfoot motion control device being perpendicular to each other, or an external surface of the rearfoot motion control device being visible from outside of the footwear.

34 Claims, 6 Drawing Sheets

U.S. PATENT DOCUMENTS

| | | | |
|---|---|---|---|
| 4,391,048 | 7/1983 | Lutz | 36/28 |
| 4,439,936 | 4/1984 | Clarke et al. | 36/102 |
| 4,439,937 | 4/1984 | Daswick . | |
| 4,445,283 | 5/1984 | Meyers | 36/29 |
| 4,449,307 | 5/1984 | Stubblefield | 36/32 |
| 4,484,397 | 11/1984 | Curley, Jr. | 36/92 |
| 4,486,964 | 12/1984 | Rudy | 36/28 |
| 4,490,928 | 1/1985 | Kawashima | 36/69 |
| 4,506,460 | 3/1985 | Rudy | 36/28 |
| 4,551,930 | 11/1985 | Graham et al. | 36/30 R |
| 4,561,195 | 12/1985 | Onoda et al. | 36/30 R |
| 4,608,768 | 9/1986 | Cavanagh | 36/28 |
| 4,614,046 | 9/1986 | Dassler | 36/30 R |
| 4,616,431 | 10/1986 | Dassler | 36/28 |
| 4,622,764 | 11/1986 | Boulier . | |
| 4,624,061 | 11/1986 | Wezel et al. | 36/30 A |
| 4,680,875 | 7/1987 | Danieli | 36/31 |
| 4,730,402 | 3/1988 | Norton et al. | 36/30 R |
| 4,731,939 | 3/1988 | Parracho et al. | 36/31 |
| 4,741,114 | 5/1988 | Stubblefield | 36/32 |
| 4,759,136 | 7/1988 | Stewart et al. | 36/114 |
| 4,766,679 | 8/1988 | Bender . | |
| 4,817,304 | 4/1989 | Parker et al. | 36/29 |
| 4,854,055 | 8/1989 | Sugiyama . | |
| 4,854,057 | 8/1989 | Misevich et al. | 36/114 |
| 5,025,573 | 6/1991 | Giese et al. | 36/30 R |
| 5,046,267 | 9/1991 | Kilgore et al. | 36/30 R |
| 5,134,791 | 8/1992 | Gregory . | |

OTHER PUBLICATIONS

Prosthetics Research, vol. 10, No. 2, pp. 55–95 (Fall 1964).

Brochure and Advertisement on a so-called ARC TM element; brochure dated 1988; Advertisement copied from Mar. 1989 edition of Runner's World.

European Search Report from corresponding European Appln. No. 88309833.7 (Pub. No. 315,340).

Article on "Shoe Corrections and Orthopaedic Foot Supports" by Wickstrom, M. D. et al., pub. vol. 70 of Clin. Orthop. pp. 30–42 (May–Jun. 1970).

Article on "Shoe Wedging" by Hack and published in vol. 58, No. 6 of the Journal of the American Podiatry Assoc., pp. 258–261 (Jun. 1968).

ATHLETIC SHOE WITH REARFOOT MOTION CONTROL DEVICE

This application is a continuation-in-part of U.S. application Ser. No. 07/433,436, filed Nov. 8, 1989, now U.S. Pat. No. 5,046,267, which is a continuation of U.S. application Ser. No. 07/115,661, filed Nov. 6, 1987, abandoned.

TECHNICAL FIELD

The invention relates to footwear, more particularly to athletic shoes, wherein a cushioning sole is provided with a rearfoot motion control device to, preferably, control the pronation motion of a wearer's foot. The sole includes a sole member which is compressible and resilient to thereby cushion foot impact, and the rearfoot motion control device increases the resistance to compression of the sole member in, preferably, the area adjacent the medial side of the sole. An integral heel support can be added to provide support to the heel and arch of a wearer's foot.

BACKGROUND OF THE INVENTION

The modern shoe, particularly an athletic shoe, is a combination of many elements which have specific functions, all of which must work together for the support and protection of the foot. Athletic shoes today are as varied in design and purpose as are the rules for the sports in which the shoes are worn. Tennis shoes, racquetball shoes, basketball shoes, running shoes, baseball shoes, football shoes, weightlifting shoes, walking shoes, etc. are all designed to be used in very specific, and very different, ways. They are also designed to provide a unique and specific combination of traction, support and protection to enhance performance. Not only are shoes designed for specific sports, they are also designed to meet the specific characteristics of the user. For example, shoes are designed differently for heavier persons than for lighter persons; differently for wide feet than for narrow feet; differently for high arches than for low arches, etc. Some shoes are designed to correct physical problems, such as over-pronation, while others include devices, such as ankle supports, to prevent physical problems from developing.

A shoe is divided into two general parts, an upper and a sole. The upper is designed to snugly and comfortably enclose the foot, while the sole must provide traction, protection, and a durable wear surface. The considerable forces generated by running require that the sole of a running shoe provide enhanced protection and shock absorption for the foot and leg. It is also desirable to have enhanced protection and shock absorption for the foot and leg in all types of footwear. Accordingly, the sole of a running shoe typically includes several layers, including a resilient, shock absorbing or cushioning layer as a midsole and a ground contacting outer sole or outsole which provides both durability and traction. This is particularly true for training or jogging shoes designed to be used over long distances and over a long period of time. A shoe also can include a heel support, or a heel counter for providing good stability and support for the heel of the foot as well as the arch of the foot. The sole also provides a broad, stable base to support the foot during ground contact.

The typical motion of the foot during running proceeds as follows. First, the heel strikes the ground, followed by the ball of the foot. As the heel leaves the ground, the foot rolls forward so that the toes make contact, and finally the entire foot leaves the ground to begin another cycle. During the time that the foot is in contact with the ground, it typically is rolling from the outside or lateral side to the inside or medial side, a process called pronation. That is, normally, the outside of the heel strikes first and the toes on the inside of the foot leave the ground last. While the foot is air borne and preparing for another cycle the opposite process, called supination, occurs. Pronation, the inward roll of the foot in contact with the ground, although normal, can be a potential source of foot and leg injury; particularly if it is excessive. The use of soft cushioning materials in the midsole of running shoes, while providing protection against impact forces, can encourage instability of the sub-talar joint of the ankle, thereby contributing to the tendency for over-pronation. This instability has been cited as a contributor to "runners knee" and other athletic injuries.

Various methods for resisting excessive pronation or instability of the sub-talar joint have been proposed and incorporated into prior art athletic shoes as "stability" devices. In general, these devices have been fashioned by modifying conventional shoe components, such as the heel counter, and by modifying the midsole cushioning materials. For example, one technique incorporates a relatively stiff heel counter support over the heel counter, as shown in U.S. Pat. No. 4,288,929 to Norton et al. A similar technique, wherein support is provided to a heel counter by a bead of material, is shown in U.S. Pat. No. 4,354,318 to Frederick et al. Another prior art technique to enhance motion control during foot impact is by building up the heel counter itself, such as shown in U.S. Pat. No. 4,255,877 to Bowerman and U.S. Pat. No. 4,287,675 to Norton et al. Another technique is the use of higher density cushioning materials on the medial side of the shoe to resist pronation, such as shown in U.S. Pat. No. 4,364,188 to Turner et al. and U.S. Pat. No. 4,364,189 to Bates. The use of a less compressible or firmer fluid tight chamber in the medial heel area of a sole is disclosed in U.S. Pat. Nos. 4,297,797 to Meyers and 4,445,283 to Meyers. Although these prior art techniques have exhibited a degree of success in controlling sub-talar joint motion and, hence, over-pronation, they have certain disadvantages. Generally, these techniques add to the weight and manufacturing expense of the shoes. Furthermore, the firmer, higher density foam midsole materials are subject to compression set and reduce the efficacy of the cushioning system.

The present invention was designed to take advantage of the lightweight cushioning capability of the materials used in current athletic shoes, while enhancing the stability of the shoes without incurring the above disadvantages of prior art "stability" devices.

SUMMARY OF THE INVENTION

The invention relates to a cushioning sole for use in footwear which includes a rearfoot motion control device to control, preferably, the pronation motion of a wearer's foot. The sole comprises a sole member which extends along at least the heel and arch areas of the sole. The sole member is compressible and resilient to thereby cushion foot impact, and includes a device incorporated into it for increasing the resistance to compression of the sole member, preferably, in an area adjacent its medial side to thereby control pronation motion. A preferred compression resistance increasing device includes at least one substantially rigid member formed of a substantially non-compressible material and extending vertically through at least a portion of the vertical extent of the sole member.

The sole member preferably extends along substantially the entire foot bed and is formed at least partially of a foam material. The compression resistance increasing device preferably includes at least one generally horizontally extending plate which gradually increases the resistance to compression of the sole member from the lateral side to a maximum adjacent the medial side of the sole member. The rigid member may be formed as at least two hollow columns spaced longitudinally from one another, and the plate extends between and laterally from adjacent the tops of the columns in a cantilever manner. The plate is preferably formed as a plurality of separate plate members which extend laterally from the medial side to an area past the center line of the heel area.

When the foot of a typical runner initially contacts the ground along the lateral heel area, the material of the sole member compresses to cushion the foot. As the runner's foot begins to roll inward (pronate), the distal ends of the plate members add a degree of resistance to compression of the sole member. As the runner's foot further rolls inward, portions of the plate members which extend in a cantilever fashion from the medial side of the sole resist compression of the sole member to a greater degree, thereby further stabilizing the foot. Maximum resistance to compression of the sole member and, hence, maximum stabilization of the foot occurs along the medial side of the sole where the vertically extending, non-compressible rigid members are disposed.

The use of the rearfoot motion control device of the present invention enables soft cushioning materials to be used in footwear soles while retaining sub-talar joint stability. The device preferably functions by increasing the compaction resistance of the medial side of the midsole, thereby resisting pronation, while the more compliant lateral side allows deflection of the lateral portion of the midsole during impact. This controlled deflection reduces the lever arm for the force acting around the sub-talar joint. The device, thus, effectively reduces calcaneal eversion at foot strike, resulting in increased resistance to pronation of the sub-talar joint and lower velocities of pronation.

The biomechanical characteristics of the rearfoot motion control device and, hence, the degree of resistance to pronation and high rates of pronation of the sub-talar joint may be varied by changing the number and height of the rigid members or columns, by changing the number, size and spacing of the separate horizontal plate members, and by changing the physical properties of the material forming the rigid member and plate members.

The use of a separate device, according to the present invention, for the control of rearfoot motion has several advantages over the prior art techniques of adjusting the densities of the cushioning materials. The stability characteristics of the shoe can be varied independently of the materials used for cushioning and is, thus, not dependent on the characteristics of these materials. Also, since the rearfoot motion control device is made of relatively high modulus and high hardness material, the device is not subject to compaction like foam cushioning materials, weighs less, is easier to manufacture, and may be combined with a variety of cushioning materials.

In another preferred embodiment, a cushioning sole for use in footwear includes a rearfoot motion control device formed integrally with a heel support. The heel support includes a section which extends upwardly and around the heel and terminates in front of the ankle of the wearer's foot. The rearfoot motion control device includes a plurality of separate plates extending in a cantilever manner and horizontally in the sole member. The separate plates gradually increase the resistance to compression of the sole from its lateral side to a maximum adjacent its medial side in order to control pronation motion. The heel support and rearfoot motion control device are preferably formed from a single piece of substantially non-compressible plastic in order to enhance overall stability of the footwear and to decrease manufacturing costs.

The rearfoot motion control device can also include two substantially rigid members spaced longitudinally from each other. The two substantially rigid members extend vertically along a portion of the sole and are substantially perpendicular to each other in order to achieve greater stability and to more easily accommodate the use of a gas filled flexible bladder within the sole.

Furthermore, the rearfoot motion control device can have an external surface, preferably on a medial side of the sole, that is visible from outside of the footwear. This surface both enhances rearfoot motion control and increases the aesthetics of the design of the shoe.

Various advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described preferred embodiments of the invention.

DETAILED DESCRIPTION OF THE INVENTION

Figure 1:
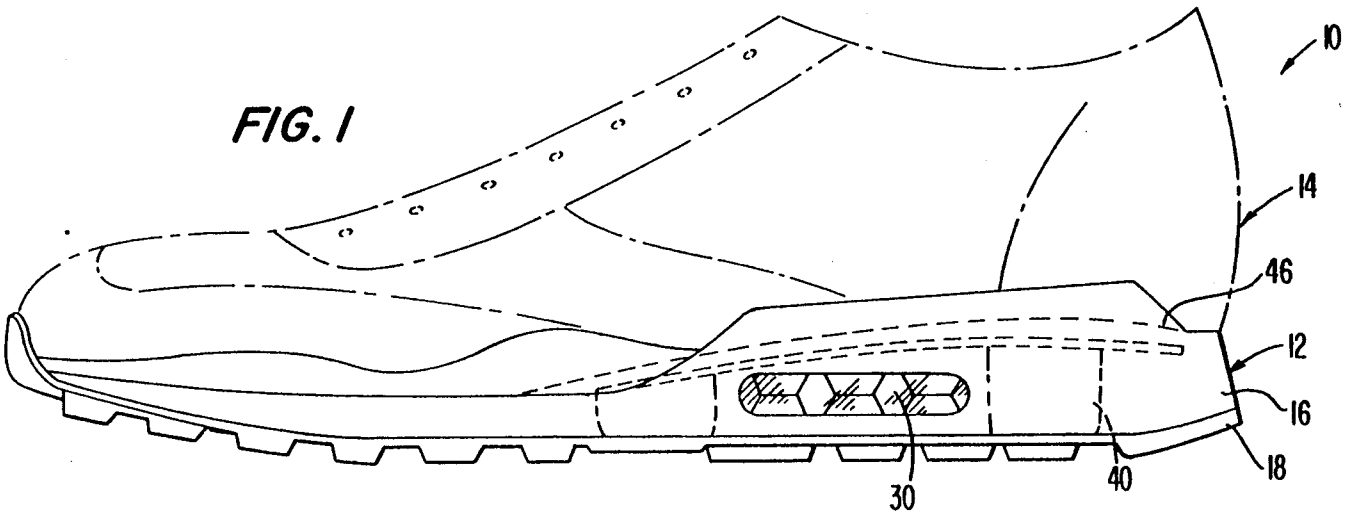
FIG. 1 is a side view of an athletic shoe embodying an invention in accordance with a first embodiment.

Referring to the drawings, wherein like numerals indicate like elements, an article of footwear in accordance with the present invention, such as a running shoe, is generally shown as 10. Shoe 10 includes a sole structure 12 and an upper 14 attached to it. Upper 14 can be of any conventional design, while sole structure 12 incorporates novel features of the present invention. Sole structure 12 includes a cushioning or force absorbing midsole 16 and a flexible, wear resistant outsole 18. Of course, where appropriate, the midsole and outsole portions can be formed as a single integral unit.

Figure 2:
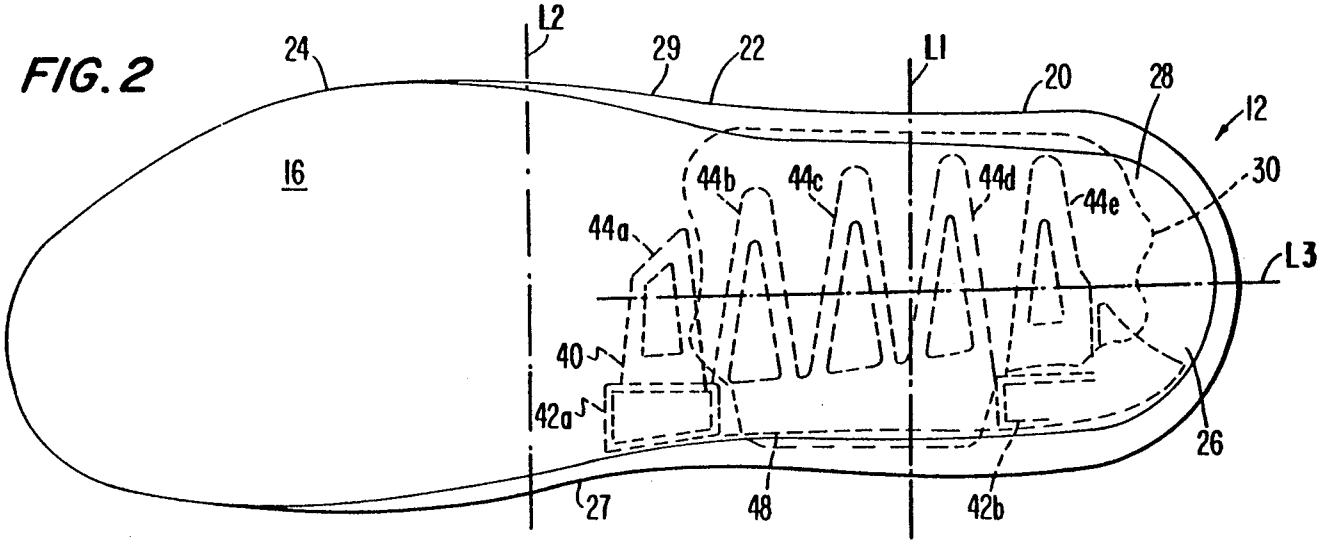
FIG. 2 is a top plan view of the sole of the athletic shoe illustrated in FIG. 1, with a rearfoot motion control device illustrated in phantom lines.

Referring to FIG. 2, shoe 10 and, hence, sole 12 can be generally divided into heel section 20 rearward of line L1, arch section 22 between lines L1 and L2, and forepart section 24 forward of line L2. Lines L1 and L2 are not precise lines of demarkation but rather divide sole 12 into relative sections related generally to portions of the human foot. Line L3 is a center line of heel section 20, which divides heel section 20 and arch section 22 into medial half 26 and lateral half 28. The medial side wall of sole 12 is indicated as 27, while the lateral side wall is indicated as 29.

Midsole 16 is formed of a cushioning, resilient foam material, such as a polyurethane foam into which sealed resilient insert 30 is encapsulated. The perimeter of insert 30 is shown diagrammatically in phantom lines in FIG. 2. Insert 30 is preferably a gas-filled bladder or chamber formed according to the teachings of U.S. Pat. Nos. 4,183,156 and 4,219,945 of Marion F. Rudy. Such a gas filled bladder is formed from a flexible material which is sealed along its perimeter and at preselected locations within its perimeter which, after being filled to a relatively high pressure by a gas having a low diffusion rate through the flexible material, takes on a generally flat bladder configuration. The bladder is thereafter encapsulated in the foam material comprising the remainder of the midsole, as disclosed in the '945 patent. Alternatively, insert 30 can be omitted and the entire midsole 16 can be formed of a cushioning foam material. In either case midsole 16 functions as a compressible and resilient unit which cushions foot impact.

A rearfoot motion control device 40 is incorporated into midsole 16 in heel section 20 and arch section 22. Device 40 is preferably formed of a single integral piece of plastic material, such as a thermoplastic polyester elastomer. The plastic material is relatively hard and substantially non-compressible. The plastic material preferably has a relatively high flex modulus, e.g. preferably 75,000 to 125,000 psi as determined by a standard ASTM test, and a hardness preferably in the range of 65 to 72 Shore D. This is in sharp contrast to the much softer foam material used in a typical midsole, such as midsole 16, which generally has a hardness in the range of 40 to 70 on the Asker C scale.

Device 40 preferably functions to gradually increase the resistance to compression of midsole 16 proceeding from a minimum resistance at the lateral side to a maximum resistance at the medial side. Device 40 includes a pair of longitudinally spaced rigid members 42*a* and 42*b* and a plurality of separate horizontal plates 44*a*, 44*b*, 44*c*, 44*d* and 44*e*. Device 40 is incorporated into midsole 16 with rigid members 42*a* and 42*b* having outer side walls 43*a* and 43*b* disposed adjacent the medial edge of midsole 16 in heel section 20 and arch section 22, and extending generally vertically. In the illustrated embodiment, rigid members 42*a* and 42*b* extend generally vertically substantially from the bottom of midsole 16 to the top of midsole 16, which is illustrated by dashed line 46. If less compaction or compression resistance is desired, the vertical extent of rigid members 42*a* and 42*b* can be decreased. Alternatively, if additional resistance to compaction is desired, an additional number of rigid members can be added along the medial side of sole 12.

In order to keep the weight of device 40 to a minimum, rigid members 42*a* and 42*b* may be formed in the shape of hollow columns having a generally rectangular cross-sectional configuration. Typically the walls of the columns have a thin cross-section or thickness, such as 0.03" to 0.04".

Figure 3:
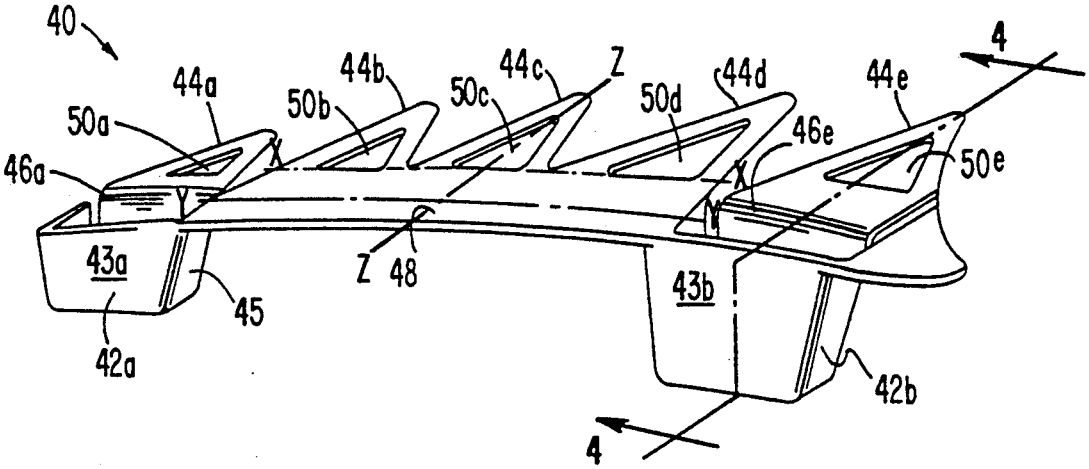
FIG. 3 is a perspective view of the rearfoot motion control device illustrated in FIGS. 1 and 2.
Figure 4:
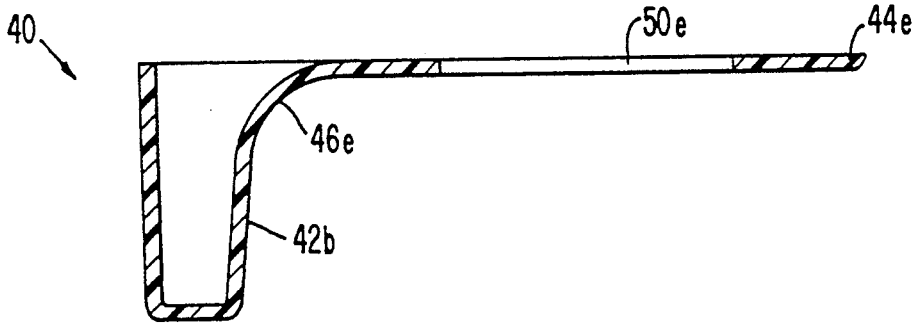
FIG. 4 is a sectional view taken generally along the lines 4—4 of FIG. 3.

As best seen in FIG. 2, plate members 44 extend horizontally from the medial side of sole member 12 toward the lateral side of sole member 12 and past the center line L3 of heel section 20. As best seen in FIGS. 3 and 4, plate members 44*a* and 44*e* extend from rigid members 42*a* and 42*b* respectively and are connected to the rigid members through downwardly extending curved sections 46*a* and 46*e*. While plate members 44*b*, 44*c* and 44*d* are separate or independent plate members, they are interconnected along line x—x to common base 48. Common base 48 is integrally connected to side wall 45 of rigid member 42*a* and generally rectangular in shape. A center line y—y extending through the shorter sides of base 48 is substantially perpendicular to side wall 45 of rigid member 42*a*. To further reduce the weight and material costs of device 40, each plate member 44 preferably has a centrally disposed gap 50*a*, 50*b*, 50*c*, 50*d* or 50*e*.

Plate members 44*a* through 44*e*, thus, extend horizontally in a cantilever manner from the medial side of sole 12. That is, plate members 44*a* and 44*e* extend laterally from the top of rigid members 42*a* and 42*b*, respectively, and plate members 44*b*, 44*c* and 44*d* extend laterally from base 48 while center line z—z of plate member 44*c* is substantially perpendicular to interconnection x—x of base 48 with plate member 44*c*. Preferably, all plate members 44 extend along an area adjacent the top of midsole 16. Plate members 44 have a perimeter which tapers from a broadest area adjacent the medial side of sole 12 to a rounded point at their distal ends on the lateral side. Plate members 44, thus, take on a finger or comb-like configuration. The tapering shape and cantilever extension of plate members 44 function to provide gradually increasing resistance to compression of sole member 12 disposed below the plate members. That is, along the distal ends of plate members 44, the plate members bend more easily and, hence, provide less resistance to compression. However, the portions of plate members 44 which are closer to their cantilever connection along the medial edge are more difficult to bend and provide increased resistance to compression. Maximum resistance to compression is reached along the medial edge of sole 12 where the rigid members 42*a* and 42*b* are located.

Figure 5:
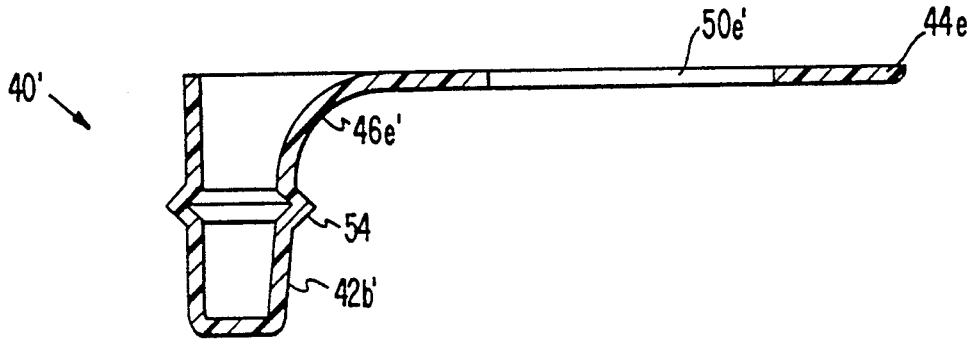
FIG. 5 is a sectional view similar to FIG. 4, illustrating a second embodiment of a rearfoot motion control device.

FIG. 5 illustrates an alternative embodiment of a device 40' wherein rigid members 42 are again formed as hollow columns. However, the hollow columns include a spring or flex section 54 which allows the columns to compress vertically a limited degree. Spring section 54 is formed as a bent out section of the column which extends horizontally around the perimeter of the hollow column, thereby forming a bendable flex line. Device 40' is used when it is desirable to vary the compliance of the columns without relying on the use of foams or adjusting the modulus of the columns.

Figure 6:
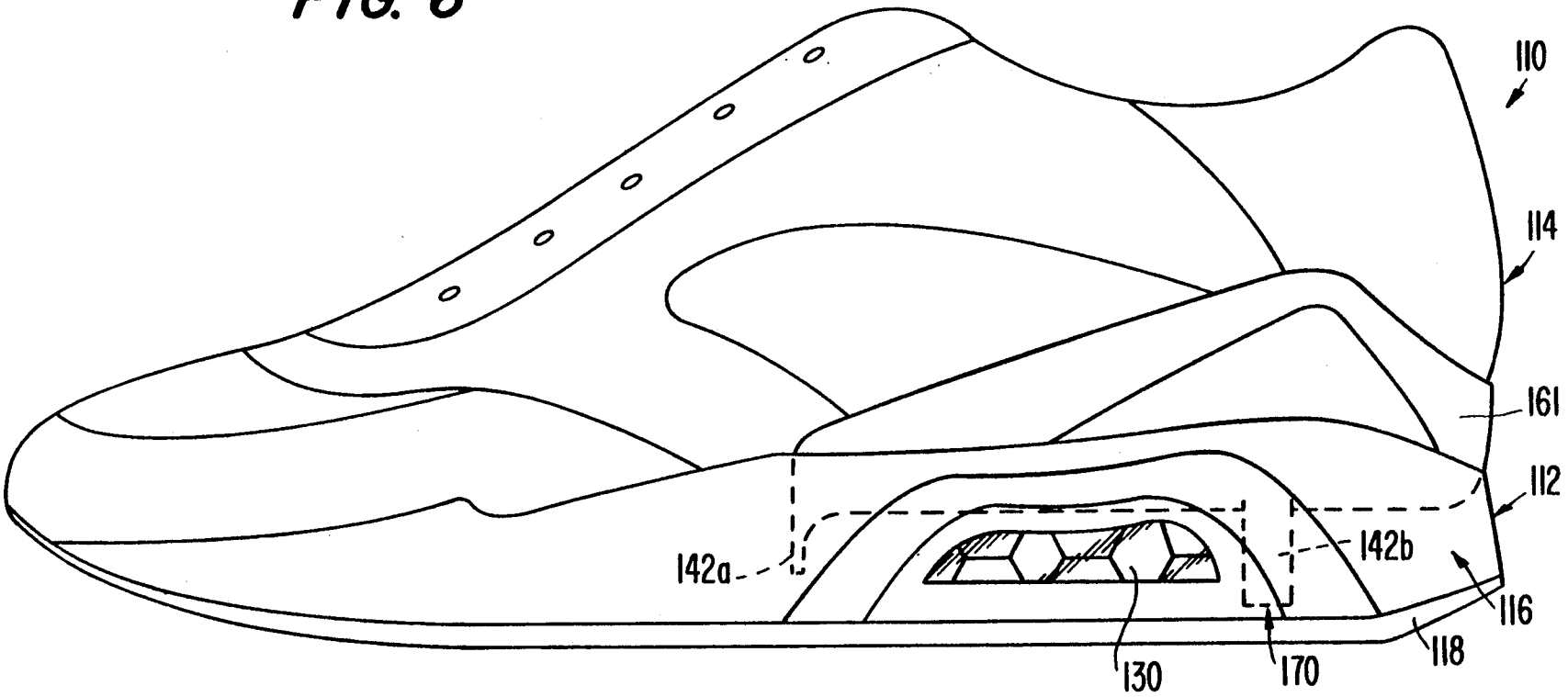
FIG. 6 is a side view of an athletic shoe embodying an invention in accordance with a third embodiment.

FIG. 6 illustrates the present invention according to a third embodiment. Shoe 110 includes sole structure 112 and upper 114 attached to it. Upper 114 can be of any conventional design, while sole structure 112 incorporates novel features of the present invention. Sole structure 112 includes cushioning or force absorbing midsole 116 and flexible, wear resistant outsole 118. Where appropriate, the midsole and outsole portions can be formed as a single integral unit.

Figure 7:
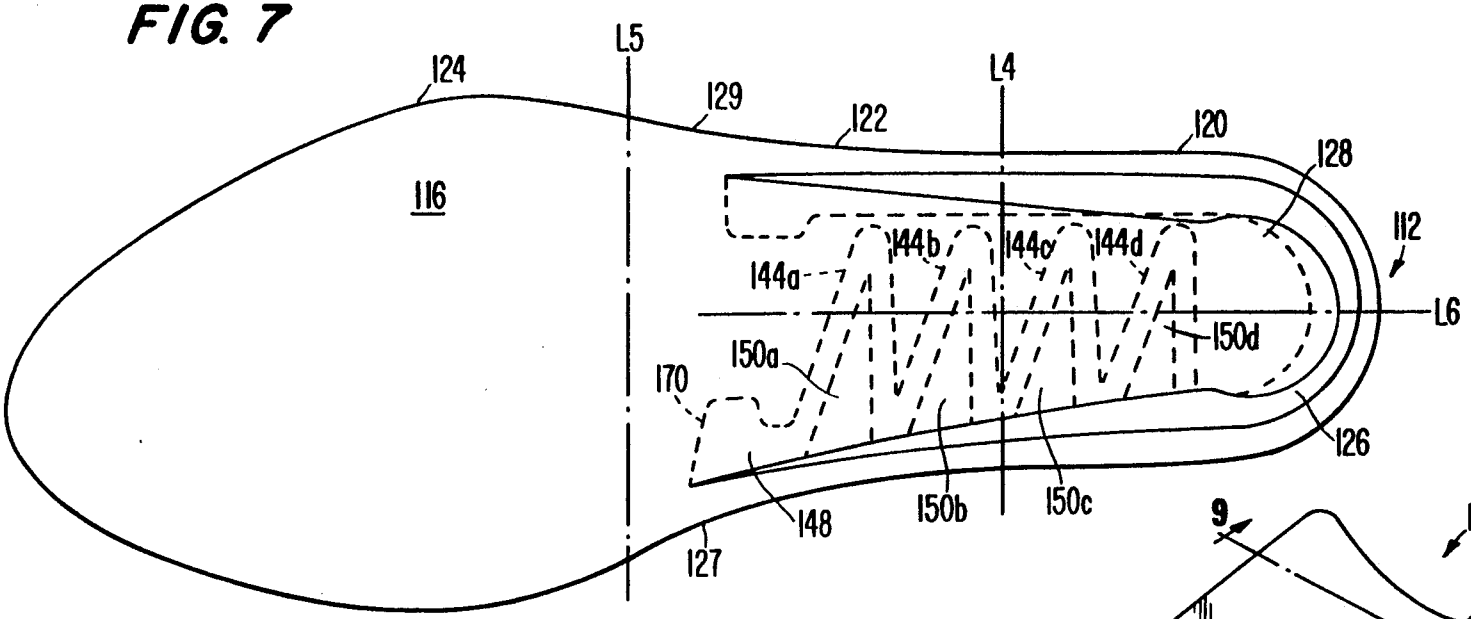
FIG. 7 is a top plan view of the sole of the athletic shoe illustrated in FIG. 6, with a portion of a combination heel support and rearfoot motion control device illustrated in phantom lines.

Referring to FIG. 7, shoe 110 and, hence, sole 112 can be generally divided into heel section 120 rearward of line L4, arch section 122 between lines L4 and L5 and forepart section 124 forward of line L5. Lines L4 and L5 are not precise lines of demarkation, but rather divide sole 112 into relative sections related generally to portions of the human foot. Line L6 is a center line of heel section 120, which divides heel section 120 and arch section 122 into medial half 126 and lateral half 128. The medial side wall of sole 112 is indicated as 127 while the lateral side wall is indicated as 129.

Midsole 116 is formed of a cushioning, resilient foam material, such as polyurethane foam into which sealed insert 130 may be encapsulated. Insert 130, shown in FIG. 6, is preferably a gas filled bladder or chamber formed according to the teachings of U.S. Pat. Nos. 4,183,156 and 4,219,945 of Marion F. Rudy. A more detailed description of a similar, but smaller insert 30 has been provided herein.

Member 170 of FIGS. 6–9 includes rearfoot motion control device 140 and heel support 160. Member 170 is incorporated into midsole 116 in heel section 120 and arch section 122. Member 170 is preferably formed of a single integral piece of plastic material, such as a thermoplastic polyester elastomer. The plastic material is relatively hard and substantially non-compressible. The plastic material preferably has a relatively high flex modulus, e.g. preferably 75,000 to 125,000 psi as determined by a standard ASTM test, and a hardness preferably in the range of 65 to 72 Shore D.

Figure 8:
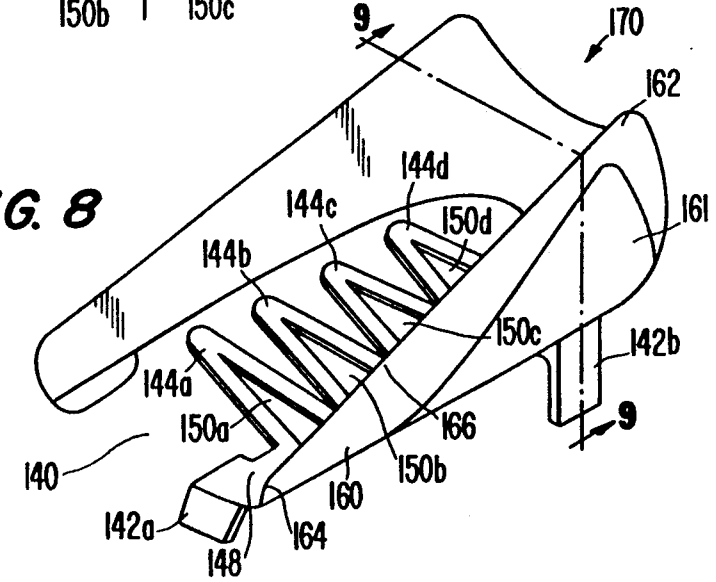
FIG. 8 is a perspective view of the combination heel support and rearfoot motion control device illustrated in FIGS. 6 and 7.

Member 170 functions to support a wearer's heel and also to gradually increase the resistance to compression of midsole 116 proceeding, preferably, from a minimum resistance at the lateral side to a maximum resistance at the medial side. As shown in FIG. 8, member 170 includes heel support 160. Heel support 160 preferably terminates in front of the ankle of the wearer's foot. Heel support 160 includes section 161 which extends upwardly around a portion of the heel of a wearer's foot. Preferably, as seen, for example, in FIG. 6, the upwardly extending section 161 of heel support 160 is disposed primarily external to sole 112.

Heel support 160 has upper edge 166. This upper edge preferably decreases from a maximum height at point 162 adjacent the heel of a wearer's foot to a minimum height at point 164 in front of the ankle and arch of a wearer's foot, thereby providing good support and stability for the heel and arch of the foot. Upper edge 166, which connects the maximum height at point 162 to the minimum height at point 164, preferably is generally in the shape of a straight line, or in other words, heel support 160 has a maximum height at point 162 and decreases generally linearly to a minimum height at point 164. Alternatively, upper edge 166 may gradually taper to the minimum height or may have a generally curved or other shape.

In addition to including heel support 160, member 170 also includes rearfoot motion control device 140 which is preferably integral with heel support 160. As seen in FIGS. 6–9, rearfoot motion control device 140 includes a pair of longitudinally spaced rigid members **142*a* and 142*b* and a plurality of substantially coplanar separate horizontal plates 144*a*, 144*b*, 144*c* and 144*d*. To provide the desired functions while reducing the weight of the shoe, it is preferred to have no more than four plates on device 140**.

Rearfoot motion control device 140 is incorporated into midsole 116 with rigid members **142*a* and 142*b* disposed adjacent the medial edge of heel support 160 and disposed adjacent midsole 116 in heel section 120 and arch section 122. Rigid members 142*a* and 142*b* extend generally vertically. In the embodiment of FIGS. 6–9, rigid members 142*a* and 142*b* extend from the top of midsole 116 down approximately two-thirds to three-quarters of midsole 116**. As discussed herein, the length and number of rigid members can be changed depending on whether less or additional compaction resistance is desired.

Rigid members **142*a* and 142*b* are spaced longitudinally from one another and are preferably perpendicular to one another for enhanced stability. As seen in FIGS. 6 and 8, first or forwardmost rigid member 142*a* is generally rectangular in shape with a longer pair of side walls of the rigid member 142*a* extending from the medial side of sole 112 generally towards the lateral side of the sole. Rigid member 142*b*** is generally rectangular in shape with the longer pair of side walls extending generally longitudinally.

Such a perpendicular relationship of rigid members can more easily accommodate the use of a larger sealed bladder or chamber 130 within midsole 116. The relationship of the rigid members to the increased cushioning insert, bladder or chamber can result in the bladder contacting a rigid member. Use of such a larger chamber in combination with a rearfoot motion control device results in additional cushioning without materially sacrificing stability.

Figure 9:
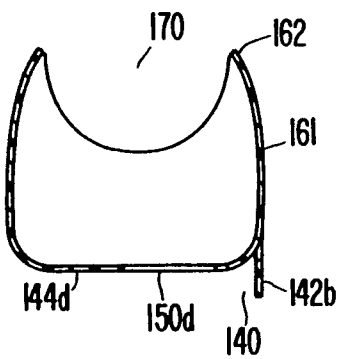
FIG. 9 is a sectional view generally taken along the lines 9—9 of FIG. 8.

As seen in FIG. 7, plate members 144 extend horizontally from the medial side of sole member 112 toward the lateral side of sole member 112 and past the center line L6 of heel section 120. As seen in FIGS. 8 and 9, plate members **144*a*, *b*, *c* and *d* are interconnected along common base 148. Common base 148 is integrally connected to rigid members 142*a* and 142*b*. To reduce weight and material cost of the rearfoot motion control device, each of the four plates has a centrally disposed gap 150*a*, 150*b*, 150*c* or 150*d***.

Plates **144*a* through 144*d*, thus, extend horizontally in a cantilever manner from the medial side of midsole 116. Plate members have a generally finger or comb-like configuration and extend horizontally from common base 148 of device 140. Plate members 144 have a perimeter which tapers from a broadest area at their proximal end adjacent the medial side of midsole 116 to a rounded point at their distal ends on the lateral side. As shown in FIGS. 7 and 8, the plate members extend between their proximal and distal ends along a generally transverse line, past center line L6. The transverse line intersects a plane containing the longer surfaces of rigid member 142*b*. The tapering shape and cantilever extension of plate members 144 function to provide gradually increasing resistance to compression of sole member 112. Preferably, with a maximum resistance to compression reached along the medial edge of midsole 116, device 140** operates to control pronation motion.

Figure 10:
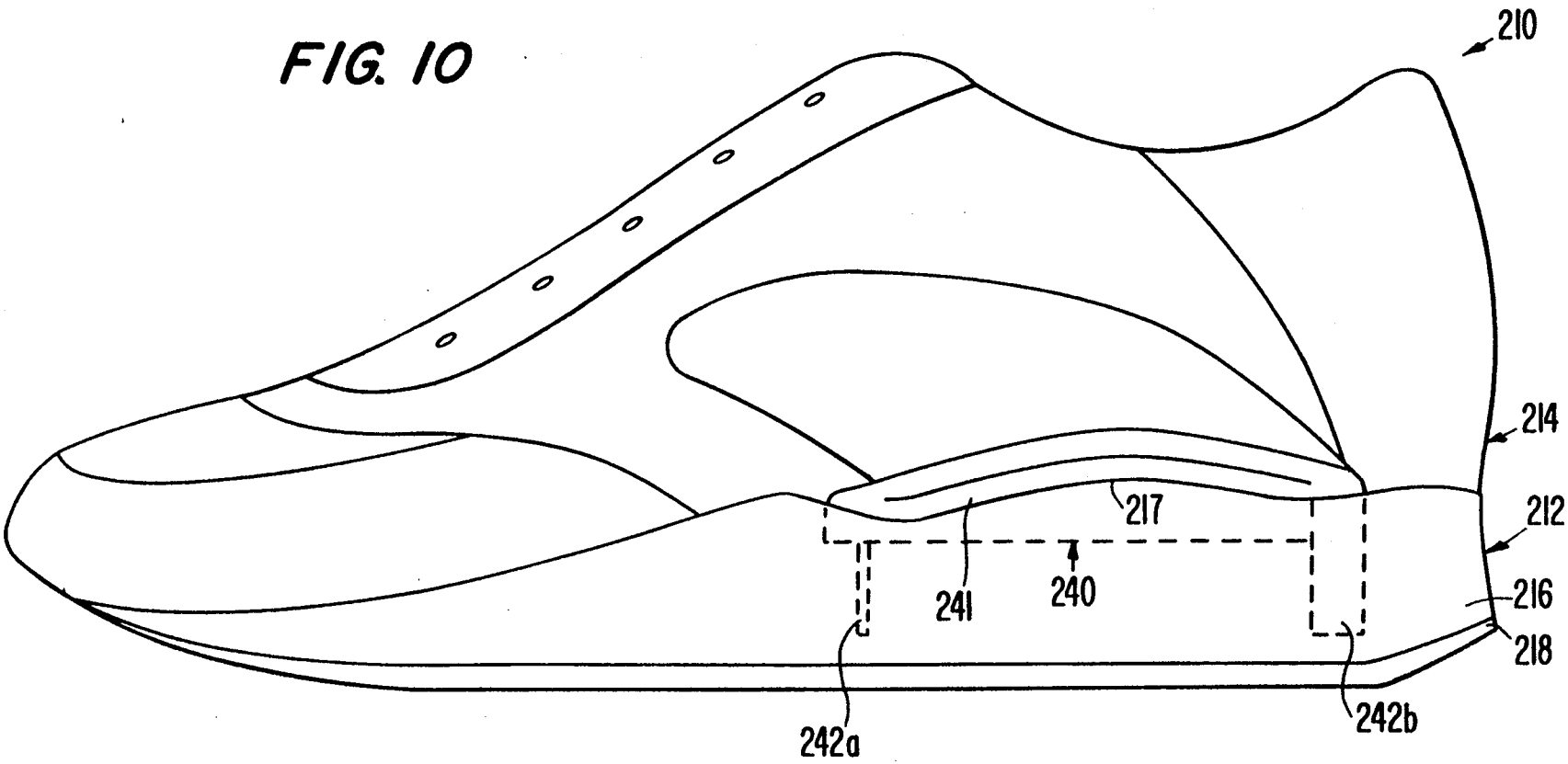
FIG. 10 is a side view of an athletic shoe embodying an invention in accordance with a fourth embodiment.

FIG. 10 is a side view of athletic shoe 210 incorporating the present invention according to a fourth embodiment. Shoe 210 includes sole structure 212 and upper 214 attached to it. Sole structure 212 includes cushioning or force absorbing midsole 216 and flexible wear resistant outsole 218. As explained for the athletic shoes of FIGS. 1 and 6, sole 212 may also be divided into heel section 220, arch section 222, medial half 226, medial side wall 227 and lateral half 228, as shown in FIG. 11.

Midsole 216 is formed of a cushioning, resilient foam material, such as polyurethane foam. A sealed resilient insert or gas filled bladder such as 30 or 130 described herein may be encapsulated into midsole 216 (not shown).

Figure 11:
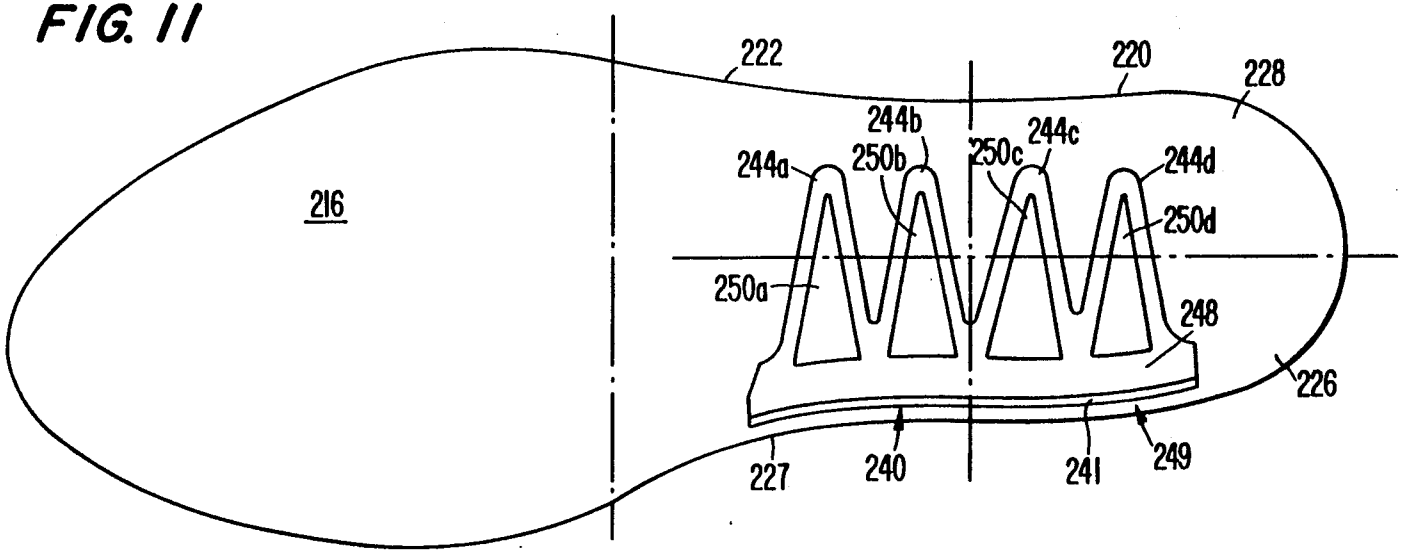
FIG. 11 is a top plan view of the sole of the athletic shoe illustrated in FIG. 10, with a portion of a rearfoot motion control device illustrated in phantom lines.
Figure 13:
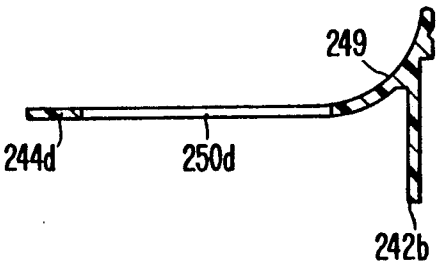
FIG. 13 is a sectional view generally taken along the lines 13—13 of FIG. 12.
Figure 12:
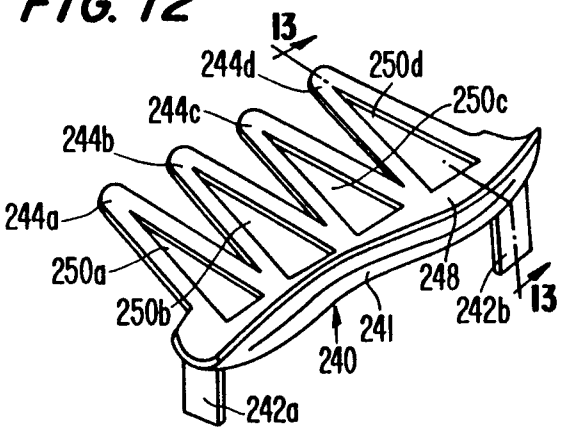
FIG. 12 is a perspective view of the rearfoot motion control device illustrated in FIGS. 10 and 11.

Referring to FIGS. 11–13, rearfoot motion control device 240 is incorporated into midsole 216 in heel section 220 and arch section 222. Device 240 is preferably formed of a single integral piece of substantially non-compressible plastic similar to the preferable materials for devices 40 and 140.

Device 240 functions to gradually increase the resistance to compression of midsole 216 proceeding, preferably, from a minimum resistance at the lateral side to a maximum resistance at the medial side. As seen in FIGS. 10–13, device 240 includes a pair of longitudinally spaced rigid members 242*a* and 242*b* and a plurality of substantially coplanar separate horizontal plates 244*a*, 244*b*, 244*c* and 244*d*. As in device 140, it is preferred to have no more than four plates on device 240.

Rearfoot motion control device 240 is incorporated into midsole 216 with rigid members 242*a* and 242*b* disposed adjacent the medial edge of midsole 216 in heel section 220 and arch sections 222. Rigid members 242*a* and 242*b* extend generally vertically along at least a portion of sole member 212 in a manner similar to and in lengths similar to device 140 discussed herein. In other words, rigid members 242*a* and 242*b* extend downward a length which is less than a thickness of sole 212, and preferably less than a thickness of midsole 216. Rigid member 242*a* is generally rectangular in shape with the longer pair of side walls extending generally latitudinally. Rigid member 242*b* is generally rectangular in shape with the longer pair of side walls extending generally longitudinally. Thus, rigid members 242*a* and 242*b* are also preferably perpendicular to each other to enhance stability and to allow for the use of a larger sealed insert within midsole 216 as discussed with respect to device 140.

Horizontal plates 244*a–d*, which extend in a cantilever manner from base 248, have a generally finger or comb-like configuration and have perimeters which taper from a broadest area adjacent base 248 and the medial side of midsole 216 to a rounded point at their distal ends on the lateral side. The plates have gaps 250*a–d* to reduce weight and material costs. The plates offer gradually increasing resistance to compression with, preferably, a maximum resistance at the medial edge of midsole 216.

Device 240 includes common base 248 having external surface 241 located above and adjacent to upper medial edge 217 of midsole 216. External surface 241 extends between rigid members 242*a* and 242*b* and is connected to the plurality of plates through curved surface 249 of base 248. This internal vertical, curved surface also assists in rearfoot motion control by gradually further limiting rearfoot motion. Thus, surface 241 functions to further increase the stability of shoe 210 to, for example, further control pronation motion.

External surface 241 is exposed on the medial side of shoe 210. Since surface 241 is visible from outside of the footwear, it may contain a visual design pattern. For example, as seen in FIGS. 10 and 12, a top and a bottom of external surface 241 can be of a curvilinear shape. In fact, the aesthetics of the external surface can take many forms to suit the design of the shoe. Thus, external surface 241 provides functional benefits by inhibiting, for example, over-pronation or over-supination and surface 241 provides an aesthetically pleasing exterior design pattern.

A preferred method of forming footwear as in shoe 210 of FIGS. 10–13 is to separately form sole 212 and rearfoot motion control device 240. Specifically, this method comprises the steps of forming rearfoot motion control device 240 which includes base 248, first and second substantially rigid members 242*a* and 242*b* which extend generally vertically from base 248, and at least one plate member 244 extending in a cantilever manner and generally horizontally from the base. The preferred method also includes forming sole 212 having a pair of recesses adjacent heel 220 and arch 222 sections of the sole, and inserting each of the rigid members into one of the recesses of the sole when device 240 is positioned adjacent sole 212. If desired, the device can then be bonded to the sole. Furthermore, if an external surface to device 240 is desired, an upper can be attached to the sole so that surface 241 of the base of the device is visible from outside of the footwear.

Each of the United States patents referenced herein are hereby incorporated by reference. Furthermore, numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope and spirit of the invention. For example, while the plates are illustrated as a plurality of separate finger like elements, the plates can be formed as a single integral plate. Similarly, while two rigid members are illustrated, where appropriate a single rigid member, or more than two rigid members can be used.

I claim:

1. A cushioning sole for use in footwear with a pronation control device to control the pronation motion of a wearer's foot comprising a sole member extending along at least the heel and arch areas of the sole, said sole member being compressible and resilient for cushioning foot impact, and means incorporated into said sole member for increasing the resistance to compression of said sole member adjacent its medial side to control pronation motion, said compression resistance increasing means including at least one substantially rigid member formed of substantially non-compressible material and extending vertically along at least a portion of the vertical extent of said sole member.

2. A cushioning sole as in claim 1, wherein said upwardly extending section of said heel supporting means is disposed primarily external to said cushioning sole.

3. A cushioning sole as in claim 1, wherein said gradual resistance increasing means further comprises:

a plate extending in a cantilever manner and generally horizontally from the medial side of said sole member.

4. A cushioning sole as in claim 3, wherein said sole member further comprises a gas filled flexible bladder encapsulated within said sole member, adjacent said rigid member and in contact with said rigid members.

5. A cushioning sole as in claim 3, wherein said plate extends past a center line of the heel section of said sole member into a lateral half of said sole member.

6. A cushioning sole as in claim 3, wherein said supporting means section extending upwardly around a portion of the wearer's heel has a maximum height adjacent the heel of a wearer's foot and decreasing linearly to a minimum height in front of the ankle of the wearer's foot.

7. A cushioning sole for use in footwear comprising:

a sole member extending along at least a heel and an arch section of the cushioning sole, said sole member being compressible and resilient for cushioning foot impact;

means, incorporated into said sole member and formed of substantially non-compressible material, for gradually increasing the resistance to compression of said sole member from its lateral side to a maximum adjacent its medial side to control pronation motion, said gradual resistance increasing means including:

a first substantially rigid member having a major surface extending generally laterally and vertically along a portion of said sole member; and a second substantially rigid member spaced longitudinally from said first substantially rigid member and having a major surface extending generally longitudinally and vertically along a portion of said sole member, wherein, said major surface of said first rigid member is substantially perpendicular to said major surface of said second rigid member.

8. A cushioning sole as in claim 7, wherein said first substantially rigid member is disposed forward of said second substantially rigid member in said sole member and said first substantially rigid member is generally rectangular in shape with a longer pair of side walls of said first substantially rigid member extending from the medial side of said sole member generally towards the lateral side of said sole member.

9. A cushioning sole as in claim 7, further comprising means, disposed on said sole member, extending around a heel and terminating in front of an ankle of a foot of a wearer of the cushioning sole, for supporting the heel of the wearer, said supporting means including a section which extends upwardly around a portion of the wearer's heel.

10. A cushioning sole as in claim 9, wherein said gradual resistance increasing means and said heel supporting means are integral to each other.

11. A cushioning sole as in claim 9, wherein said upwardly extending section of heel supporting means is disposed primarily external to said cushioning sole.

12. A cushioning sole as in claim 7, wherein said gradual compression resistance increasing means further comprises a plate extending in a cantilever manner and generally horizontally from the medial side of said sole member.

13. A cushioning sole as in claim 12, wherein said plate extends past a center line of the heel section of said sole member into a lateral half of said sole member.

14. A cushioning sole as in claim 7, wherein said sole member further comprises a gas filled flexible bladder encapsulated within said sole member, adjacent said rigid members and in contact with at least one of said rigid members.

15. A cushioning sole as in claim 7, wherein said gradual resistance increasing means has an external surface on the medial side of said sole that is visible from outside of the footwear.

16. The cushioning sole as in claim 7, wherein, the first rigid member extends substantially perpendicular to a horizontal plane extending through said sole member.

17. Footwear comprising:

a sole member extending along at least a heel and an arch section of the footwear and being compressible and resilient for cushioning foot impact;

a common base formed of substantially non-compressible material and disposed within said sole member;

a plurality of plates formed of substantially non-compressible material, incorporated into said sole member, integrally connected to said common base and extending said common base;

a first substantially rigid member formed of substantially non-compressible material, incorporated into said sole member, integrally connected to said common base, disposed adjacent a side wall of said sole member and having a major surface extending generally vertically and laterally in said sole member; and a second substantially rigid member spaced longitudinally from said first substantially rigid member, formed of substantially non-compressible material, incorporated into said sole member, integrally connected to said common base, disposed adjacent a side wall of said sole member and having a major surface extending generally vertically and longitudinally in said sole member, wherein, said major surface of said first rigid member is substantially perpendicular to said major surface of said second rigid member.

18. A cushioning sole as in claim 17, wherein said first substantially rigid member is disposed forward of said second substantially rigid member in said sole member and said first substantially rigid member is generally rectangular in shape with a longer pair of side walls of said first substantially rigid member extending from the medial side of said sole member generally towards the lateral side of said sole member.

19. Footwear comprising:

a sole member extending along at least a heel and an arch section of the footwear and being compressible and resilient for cushioning foot impact;

a common base formed of substantially non-compressible material and disposed within said sole member, said common base having an external surface on a medial side of said sole member that is visible from outside of the footwear; and a plurality of plates formed of substantially non-compressible material, incorporated into said sole member, integrally connected to said common base and extending from said common base past a center line of the heel section of said sole member into a lateral half of said sole member, said plurality of plates having a proximal end and a distal end, said proximal end and said distal end defining between them a portion extending substantially along a transverse line which is substantially perpendicular to said common base, said proximal end integrally connected to said common base and said distal end cantilevered from said common base, said distal end extending past a centerline of the heel section of said sole member into an opposite side of the heel section centerline on which said proximal end is disposed.

20. Footwear as in claim 19, wherein said external surface is connected to said plurality of plates through a curved surface.

21. Footwear as in claim 19, further comprising a substantially rigid member formed of substantially non-compressible material, incorporated into said sole member, integrally connected to said common base, disposed adjacent a side wall of said sole member and extending generally vertically in said sole member.

22. Footwear as in claim 21, further comprising a gas filled flexible bladder encapsulated within said sole member, adjacent said rigid member and in contact with said rigid member.

23. Footwear as in claim 21, wherein:

said substantially rigid member is a first substantially rigid member;

said footwear further comprises a second substantially rigid member spaced longitudinally from said first substantially rigid member and extending generally vertically through a portion of said sole member.

24. A cushioning sole as in claim 19, wherein a top and a bottom of said external surface are curvilinear in shape.

25. A cushioning sole as in claim 19, wherein said plurality of plates comprises no more than four plates.

26. A cushioning sole for use in footwear comprising:

a sole member extending along at least a heel and an arch section of the cushioning sole, said sole member being compressible and resilient for cushioning foot impact;

means, incorporated into said sole member and formed of substantially non-compressible material, for gradually increasing the resistance to compression of said sole member from its lateral side to a maximum adjacent its medial side to control pronation motion, said gradual resistance increasing means including:

a first substantially rigid member having longer surfaces extending generally vertically along a portion of said sole member;

a second substantially rigid member spaced longitudinally from said first substantially rigid member and extending generally vertically along a portion of said sole member; and a plurality of substantially co-planar plates extending in a cantilever manner and generally horizontally from the medial side of said sole member;

wherein a first of said plurality of plates has a proximal end and a distal end, said proximal end integrally connected to said first substantially rigid member and said distal end cantilevered from said first substantially ridge member, and a second of said plurality of plates has a proximal end and a distal end, said proximal end of said second plate integrally connected to said second substantially rigid member and said distal end cantilevered from said second substantially rigid member, said proximal end and said distal end of said first of said plurality of plates defining between them a portion extending substantially along a transverse line which intersects a plane parallel to the longer surfaces of said first substantially rigid member, said distal end of said first of said plurality of plates extending past a centerline of the heel section of said sole member into an opposite side of the heel section centerline on which said proximal end is disposed; and said gradual resistance increasing means having an external surface on the medial side of said sole that is visible from outside of the footwear.

27. A cushioning sole as in claim 26, wherein said first and second substantially rigid members extend downward a length which is less than a thickness of said sole member.

28. A cushioning sole as in claim 26, wherein said plurality of plates extend past a center line of the heel section of said sole member into a lateral half of said sole member.

29. A cushioning sole according to claim 26, wherein said external surface is connected to said plurality of plates through a curved surface.

30. A cushioning sole as in claim 26, further comprising a gas filled flexible bladder encapsulated within said sole member, adjacent said rigid members and in contact with a least one of said rigid members.

31. A cushioning sole as in claim 26, wherein a top and a bottom of said external surface are curvilinear in shape.

32. A cushioning sole as in claim 26, wherein said external surface extends between said substantially rigid members.

33. Footwear comprising:

a sole member extending along at least a heel and an arch section of the footwear and being compressible and resilient for cushioning foot impact;

a common base formed of substantially non-compressible material and disposed within said sole member, said common base having an external surface on a medial side of said sole member that is visible from outside of the footwear;

a plurality of plates formed of substantially non-compressible material, incorporated into said sole member, integrally connected to said common base and extending from said common base past a center line of the heel section of said sole member into a lateral half of said sole member;

a first substantially rigid member formed of substantially non-compressible material, incorporated into said sole member, integrally connected to said common base, disposed adjacent a side wall of said sole member and having a major surface extending generally longitudinally and vertically in said sole member; and a second substantially rigid member spaced longitudinally from said first substantially rigid member and having a major surface extending generally laterally and vertically through a portion of said sole member, wherein, said major surface of said first rigid member is substantially perpendicular to said major surface of said second rigid member.

34. A cushioning sole for use in footwear comprising:

a sole member extending along at least a heel and an arch section of the cushioning sole, said sole member being compressible and resilient for cushioning foot impact;

a substantially rigid member formed of substantially non-compressible material, extending generally vertically through a portion of said sole member and incorporated into a medial half of said sole member;

a plurality of substantially coplanar plates formed of substantially non-compressible material incorporated into said sole member and extending from said substantially rigid member in a direction towards a lateral half of said sole member, said plates having a proximal end and a distal end and extending along a longitudinal axis between said proximal end and said distal end, said longitudinal axis substantially perpendicular to the centerline of the hell section of said sole member, said proximal end integrally connected to said substantially rigid member and said distal end cantilevered from said substantially rigid member; and means for supporting the heel of the wearer of the cushioning sole, said means extending along both the medial and lateral sides of a heel of a foot of a wearer and at least partially about the rear of the heel from each of the medial and lateral sides, said supporting means including a section on said medial and lateral sides which extends upwardly around a portion of the wearer's heel;

wherein said substantially rigid member, said plates and at least a portion of said heel supporting means define an integral structure.

* * * * *